US007817172B2

(12) United States Patent
Hong et al.

(10) Patent No.: US 7,817,172 B2
(45) Date of Patent: Oct. 19, 2010

(54) CIRCUIT FOR GENERATING GATE PULSE MODULATION SIGNAL AND LIQUID CRYSTAL DISPLAY DEVICE HAVING THE SAME

(75) Inventors: Seong Il Hong, Gyeongsangbuk-do (KR); Hwa Young Kim, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 965 days.

(21) Appl. No.: 11/645,747

(22) Filed: Dec. 27, 2006

(65) Prior Publication Data

US 2008/0001887 A1 Jan. 3, 2008

(30) Foreign Application Priority Data

Jun. 29, 2006 (KR) ..... 10-2006-0059959

(51) Int. Cl.
*G09G 5/10* (2006.01)

(52) U.S. Cl. ..... 345/691; 345/99

(58) Field of Classification Search ..... 345/87, 345/88, 94–96, 98–100, 204, 690–693
See application file for complete search history.

(56) References Cited

U.S. PATENT DOCUMENTS 5,172,038 A * 12/1992 Page et al. ..... 318/373
6,897,884 B2 * 5/2005 Tsuge et al. ..... 345/690
2002/0190326 A1 12/2002 Nagao et al.
2005/0078100 A1 4/2005 Tsujino et al.
2005/0276085 A1 * 12/2005 Winn ..... 363/132
2006/0001640 A1 * 1/2006 Lee ..... 345/100
2006/0284815 A1 12/2006 Kwon et al.

FOREIGN PATENT DOCUMENTS

JP 10-161084 6/1998
JP 2003-101394 4/2003
JP 2005-093028 A 4/2006
JP 2006-350289 12/2006

* cited by examiner

*Primary Examiner*—Ricardo L Osorio
(74) *Attorney, Agent, or Firm*—Morgan Lewis & Bockius LLP

(57) ABSTRACT

A circuit for generating a gate pulse modulation signal includes a gate pulse modulation unit for generating two gate ON voltage modulation signals by using two clock signals each having a different phase, a level shift unit for generating level-shifted and modulated clock signals of odd-numbered and even-numbered lines by using the gate ON voltage modulation signal, and a GIP for receiving the clock signals of the odd-numbered and even-numbered lines and outputting the clock signals to each corresponding gate line.

5 Claims, 6 Drawing Sheets

CIRCUIT FOR GENERATING GATE PULSE MODULATION SIGNAL AND LIQUID CRYSTAL DISPLAY DEVICE HAVING THE SAME

This application claims the benefit of the Korean Patent Application No. 10-2006-0059959 filed in Korea on Jun. 29, 2006, which is hereby incorporated by reference in its entirety.

BACKGROUND OF THE INVENTION

1. Field of the Invention

Embodiments of the present invention relate to a liquid crystal display device, and more particularly, to a circuit for generating gate pulse modulation signal for a liquid crystal display device. Embodiments of the present invention are suitable for a wide scope of applications. In particular, embodiments of the present invention are suitable for reducing the appearance of flickers in a liquid crystal display device.

2. Description of the Related Art

In general, a liquid crystal display (LCD) device includes a liquid crystal panel having gate lines and data lines and a gate driver for supplying gate signals to the gate lines. The gate driver is constructed such that a driver chip is mounted on a flexible printed circuit board at an edge portion of the liquid crystal panel. Recently, however, a GIP (gate in panel) technique has been employed to mount the gate driver on the liquid crystal panel.

A driving method of the gate driver can be classified into a non-overlapping driving method and an overlapping driving method. According to the non-overlapping driving method, the gate driver is operated in synchronization with a single clock signal (FLK) sequentially provided. According to the overlapping driving method, the gate driver is operated in synchronization with two non-overlapping clock signals (2-phase non-overlapping clocks).

FIG. 1 shows an example of a gate pulse modulation signal generated with a non-overlapping driving method according to the related art. Referring to FIG. 1(*a*), a single clock signal FLK is provided. A gate on voltage modulation signal VGHM is generated in synchronization with the single clock signal FLK, as shown in FIG. 1(*b*). The generated VGHM signal is level-shifted to generate a final gate output signal as shown in FIG. 1(*c*).

FIG. 2 shows an example of gate pulse modulation signals generated with the overlapping driving method according to the related art. Referring to FIG. 2, a clock signal FLK is provided as shown in FIG. 2(*a*). A gate ON voltage modulation signal VGHM is generated in synchronization with the clock signal FLK as shown in FIG. 2(*b*). As shown in FIGS. 2(*c*) to 2(*e*), the gate driver of the liquid crystal panel generates gate output signals, each having a period of 2 H and two modulation intervals using a gate high voltage VGH and a gate low voltage VGL. The gate output signals shown in FIGS. 2(*c*) to 2(*e*) have a dipping point at a middle portion thereof, making charging unstable and causing defects on the display panel, such as a vertical line.

FIG. 3 shows other examples of gate pulse modulation signals generated with the overlapping driving method according to the related art. Referring to FIG. 3, gate pulse modulation signals are generated using clock signals that can cover the period 2 H. Specifically, as shown in FIG. 3(*a*), a clock signal FLK is provided that can cover a period 2 H. A gate ON voltage modulation signal VGHM is generated in synchronization with the clock signal FLK as shown in FIG. 3(*b*). The VGHM signal is level-shifted to generate final gate output signals as shown in FIGS. 3(*c*) to 3(*e*). In this case, however, because gate modulation is made only at the middle portion of the gate output signal as shown in FIG. 3D, a desired output waveform cannot be obtained.

In accordance with the related art using a single clock signal FLK, when the overlapping driving method is applied to the gate lines in a GIP circuit to improve charging characteristics of the signals, because the period of the gate output is 2 H, it is not possible to output a signal for simultaneously modulating outputs of the odd-numbered gate lines and the even-numbered gate lines.

SUMMARY OF THE INVENTION

Accordingly, embodiments of the present invention are directed to a circuit for generating a gate pulse modulation signal and a liquid crystal display device having the same, which substantially obviate one or more problems due to limitations and disadvantages of the related art.

An object of the present invention is to provide a circuit for generating a gate pulse modulation signal that reduces the appearance of flickers on a liquid crystal display panel.

Another object of the present invention is to provide liquid crystal device having a circuit for generating a gate pulse modulation signal that reduces the appearance of flickers.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these and other advantages and in accordance with the purpose of the present invention, as embodied and broadly described, a circuit for generating a gate pulse modulation signal includes a gate pulse modulation unit for generating two gate ON voltage modulation signals by using two clock signals each having a different phase, a level shift unit for generating level-shifted and modulated clock signals of odd-numbered and even-numbered lines by using the gate ON voltage modulation signal, and a GIP for receiving the clock signals of the odd-numbered and even-numbered lines and outputting the clock signals to each corresponding gate line.

In another aspect, a liquid crystal display device includes a gate pulse modulation unit having first and second gate pulse modulators for generating first and second gate ON voltage modulation signals by using first and second clock signals shifted with respect to one another, a level shift unit having first and second level shifters for generating clock signals of odd-numbered and even-numbered lines in a modulated form after being level shifted by using the first and second gate ON voltage modulation signals, and a GIP for receiving the clock signals of odd-numbered and even-numbered lines and outputting the clock signals to the even-numbered and odd-numbered gate lines, respectively.

In another aspect, a liquid crystal display device includes a liquid crystal panel, first and second gate pulse modulators receiving first and second clock signals shifted with respect to one another and generating first and second gate voltage modulation signals overlapping each other, respectively, first and second level shifters receiving the first and second gate voltage modulation signals and generating first and second modulated clock signals corresponding to odd-numbered and even-numbered lines of the liquid crystal panel, respectively, the modulated clock signals overlapping each other, and a gate driver in the liquid crystal panel to receive the first and second modulated clock signals and generate first and second modulated gate output signals corresponding to adjacent gate lines of the liquid crystal panel, the first and second modulated gate output signals shifted with respect to each other to overlap one another.

In another aspect, a method for driving a liquid crystal display device including a liquid crystal panel and a gate driver in the liquid crystal panel includes modulating first and second clock signals shifted with respect to one another to generate first and second gate voltage modulation signals overlapping each other, respectively, level shifting the first and second gate voltage modulation signals to generate first and second modulated clock signals corresponding to odd-numbered and even-numbered lines of the liquid crystal panel, respectively, the modulated clock signals overlapping each other, and inputting the first and second modulated clock signals to the gate driver to generate first and second modulated gate output signals corresponding to adjacent gate lines of the liquid crystal panel, the first and second modulated gate output signals shifted with respect to each other to overlap one another.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF EXEMPLARY EMBODIMENTS

Reference will now be made in detail to exemplary embodiments of the present invention, which are illustrated in the accompanying drawings. Wherever possible, the same reference numbers will be used throughout the drawings to refer to the same or like parts.

Figure 1:
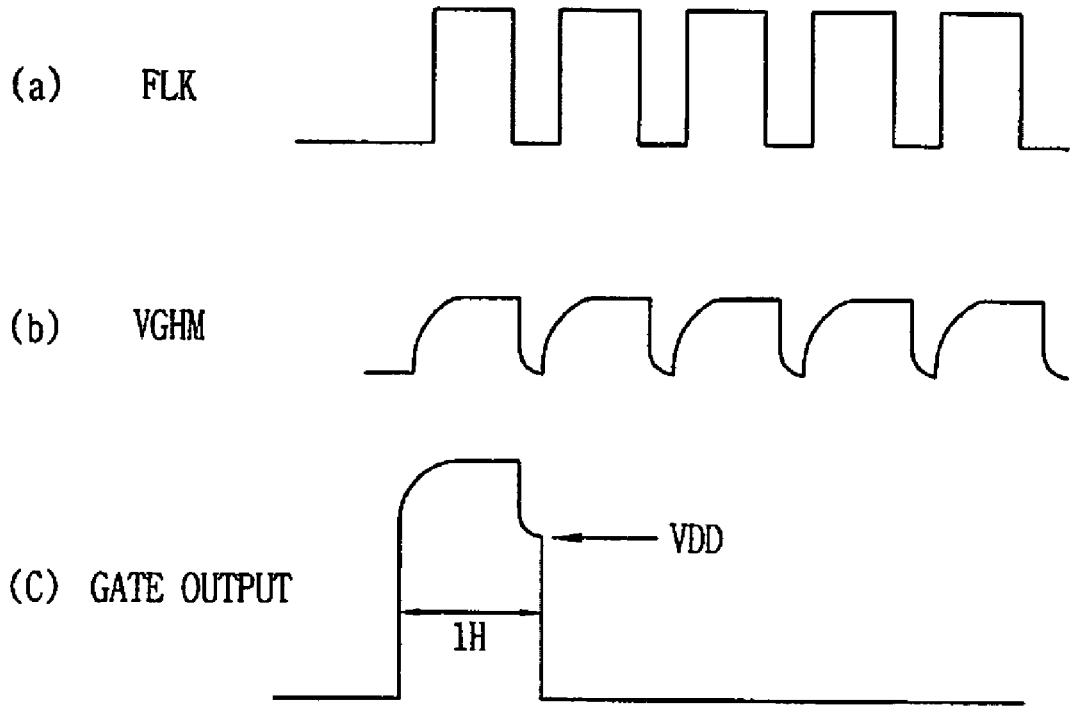
FIG. 1 RELATED ART
FIG. 1 shows examples of gate pulse modulation signals generated with a non-overlapping driving method according to the related art.
Figure 2:
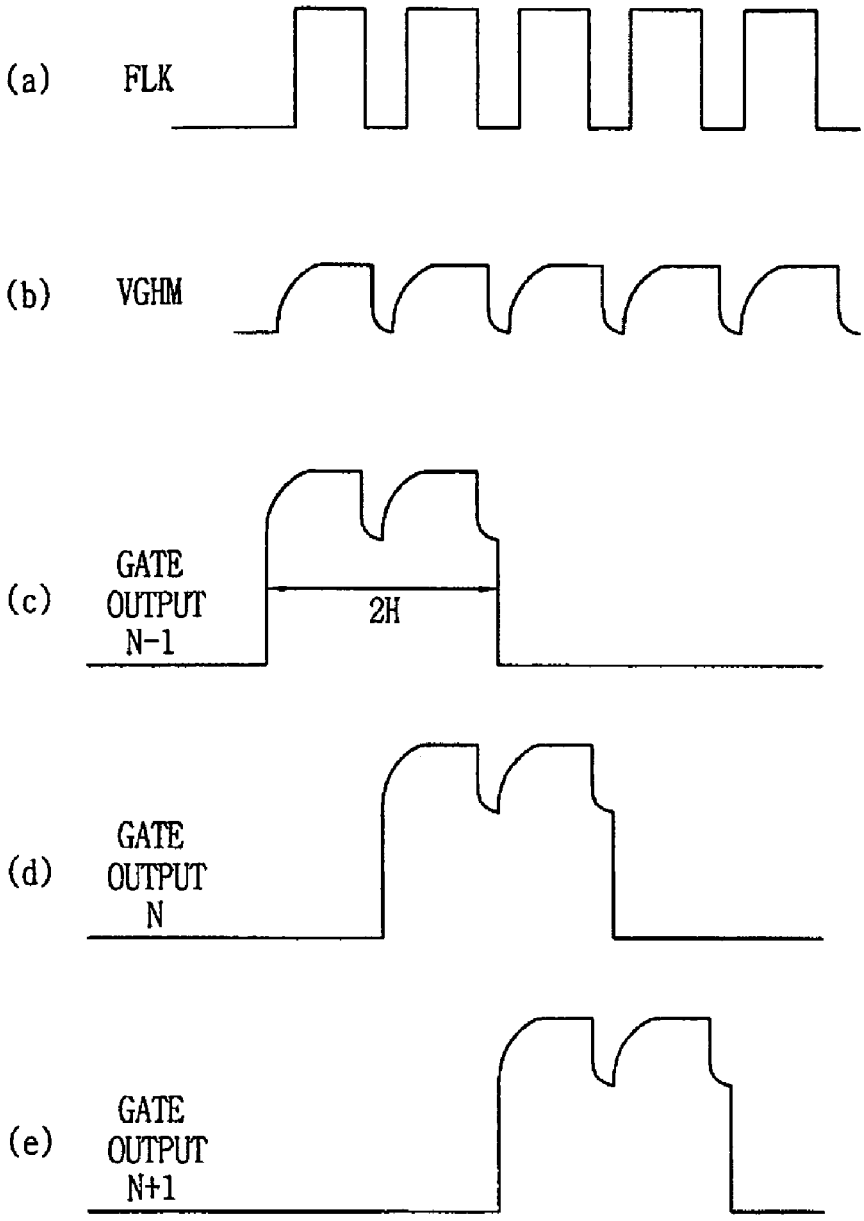
FIG. 2 RELATED ART
FIG. 2 shows examples of gate pulse modulation signals generated with the overlapping driving method according to the related art.
Figure 3:
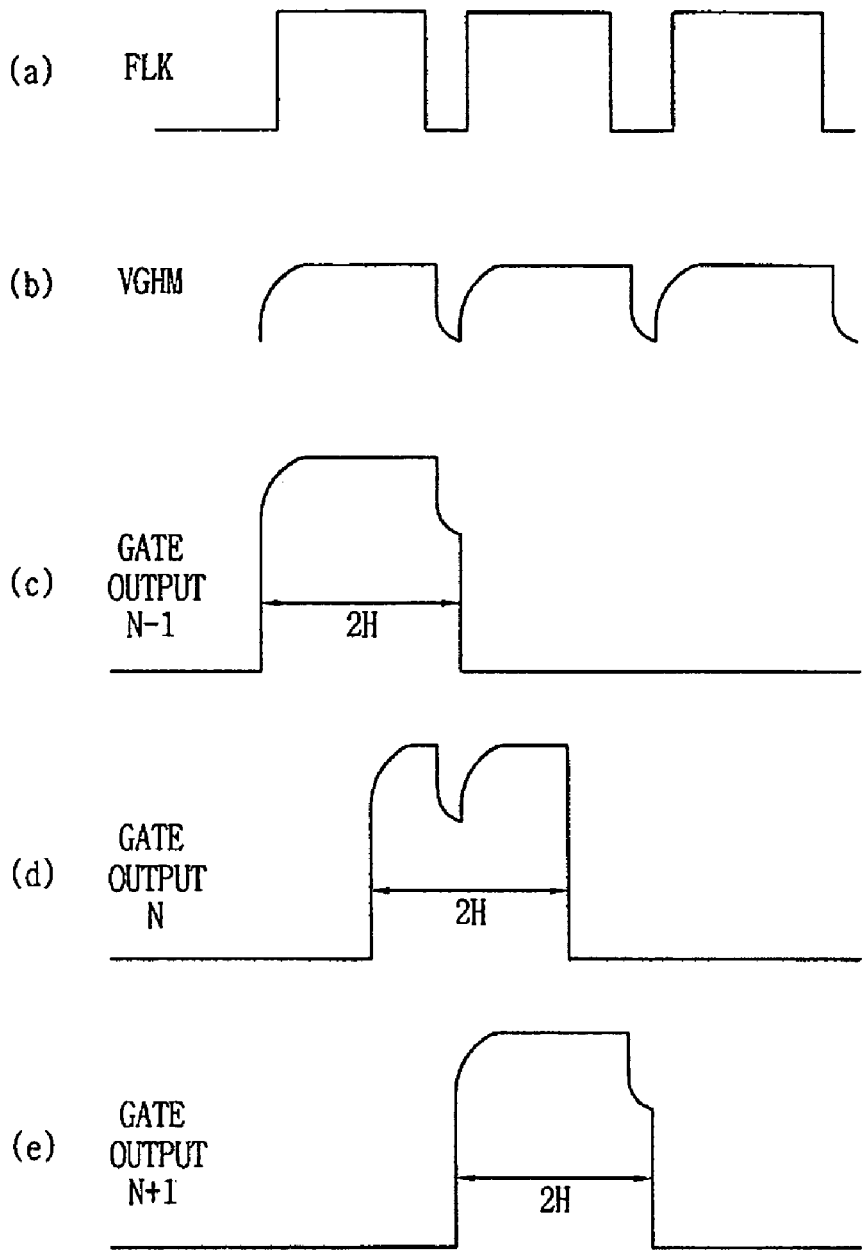
FIG. 3 RELATED ART
FIG. 3 shows other examples of gate pulse modulation signals generated with the overlapping driving method according to the related art.
Figure 4:
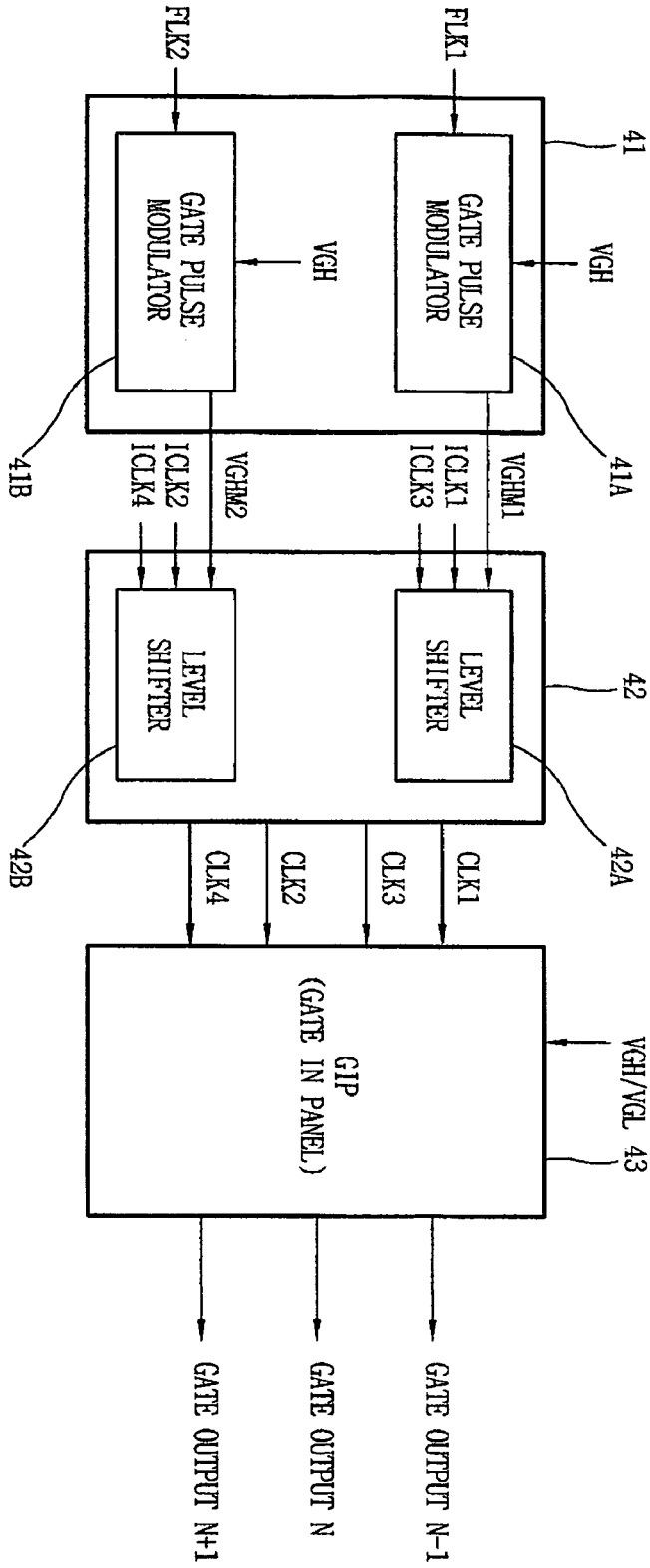
FIG. 4 shows a schematic diagram of an exemplary circuit for generating a gate pulse modulation signal according to an embodiment of the present invention.

FIG. 4 shows a schematic diagram of an exemplary circuit for generating a gate pulse modulation signal according to an embodiment of the present invention. Referring to FIG. 4, the circuit for generating a gate pulse modulation signal includes first and second gate pulse modulators 41A and 41B, first and second level shifters 42A and 42B, and GIP 43. The first and second gate pulse modulators 41A and 41B receive first and second clock signals FLK1 and FLK2 and generate first and second gate ON voltage modulation signals VGHM1 and VGHM2, respectively.

The first and second level shifters 42A and 42B receive the first and second gate ON voltage modulation signals VGHM1 and VGHM2 and first to fourth clock signals ICLK1, ICLK3, ICLK2 and ICLK4 from a timing controller (not shown). Then, the first and second level shifters 42A and 42B generate clock signals CLK1, CLK3, CLK2 and CLK4 corresponding to even-numbered and odd-numbered lines of the liquid crystal panel. The clock signals CLK1, CLK3, CLK2 and CLK4 are generated in a modulated form of a gate low voltage VGL to a gate high voltage VGH with a period 2 H.

The GIP 43 receives the clock signals CLK1, CLK3, CLK2 and CLK4 of the odd-numbered and even-numbered lines from the first and second level shifters 42A and 42, The GIP 43 generates modulated gate output signals GATE OUTPUT N−1, GATE OUTPUT N and GATE OUTPUT N+1. Then, the GIP 43 outputs the modulated gate output signals GATE OUTPUT N−1, GATE OUTPUT N and GATE OUTPUT N+1 to gate lines of the liquid crystal panel.

Figure 5:
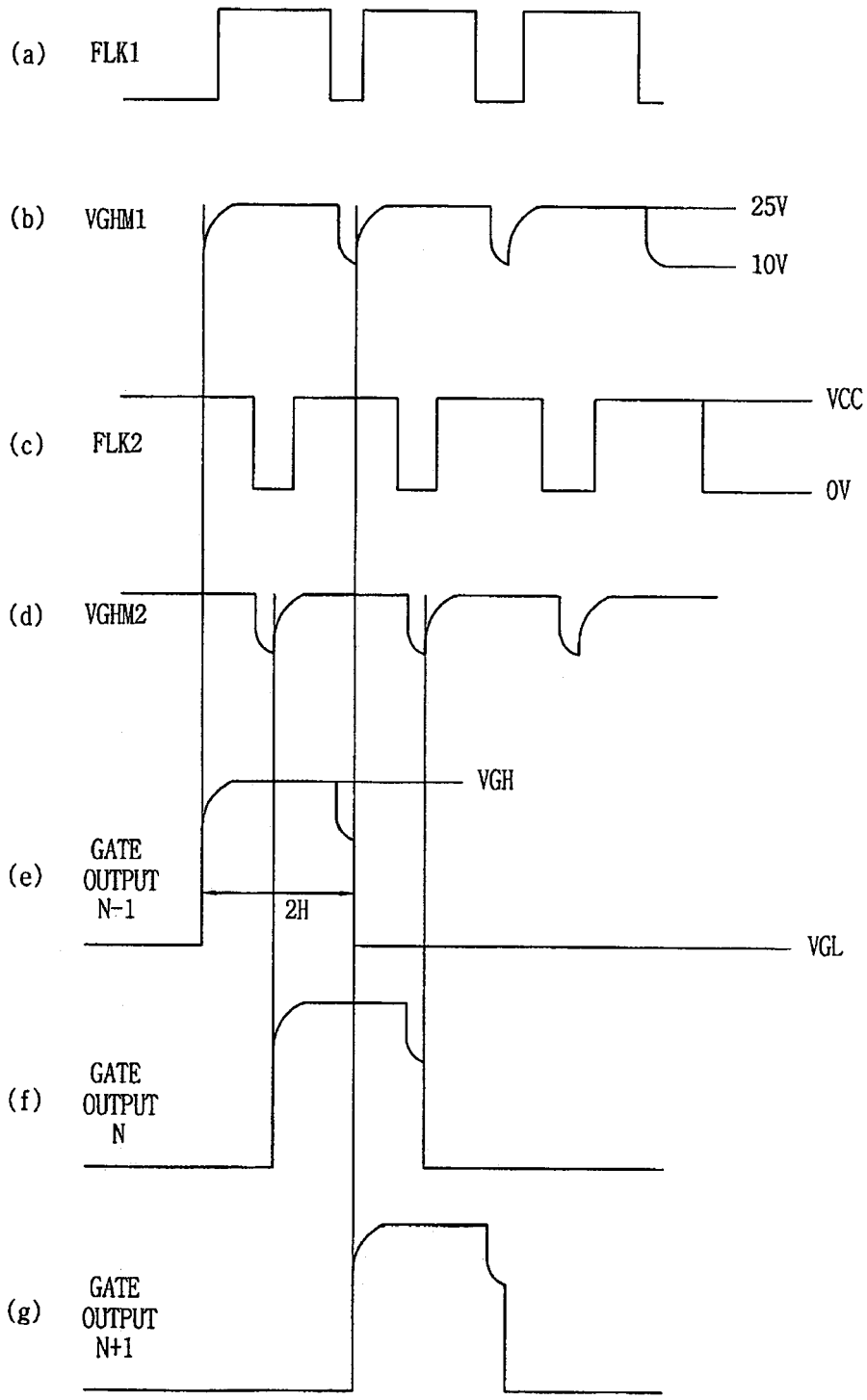
FIG. 5 shows exemplary gate pulse modulation signals generated with the overlapping driving operation according to an embodiment of the invention.

FIG. 5 shows exemplary gate pulse modulation signals generated with the overlapping driving operation according to an embodiment of the invention. Referring to FIGS. 4 and 5, the first gate pulse modulator 41A receives the first clock signal FLK1 as shown in FIG. 5(*a*) and generates a first gate ON voltage modulation signal VGHM1 as shown in FIG. 5(*b*). The VGH voltage is a high logical voltage of a scan pulse greater than a threshold voltage of a TFT. Similarly, the second gate pulse modulator 41B receives the second clock signal FLK2 and the VGH voltage as shown in FIG. 5(*c*) and generates a second gate ON voltage modulation signal VGHM2 as shown in FIG. 5(*d*). The first and second clock signals FLK1 and FLK2 are shifted with respect to one another to be overlapped. The overlapped part can be for example 1 H. Similarly, the first and second VGHM1 and VGHM2 signals are shifted with respect to one another to be overlapped, for example by 1 H.

Figure 6:
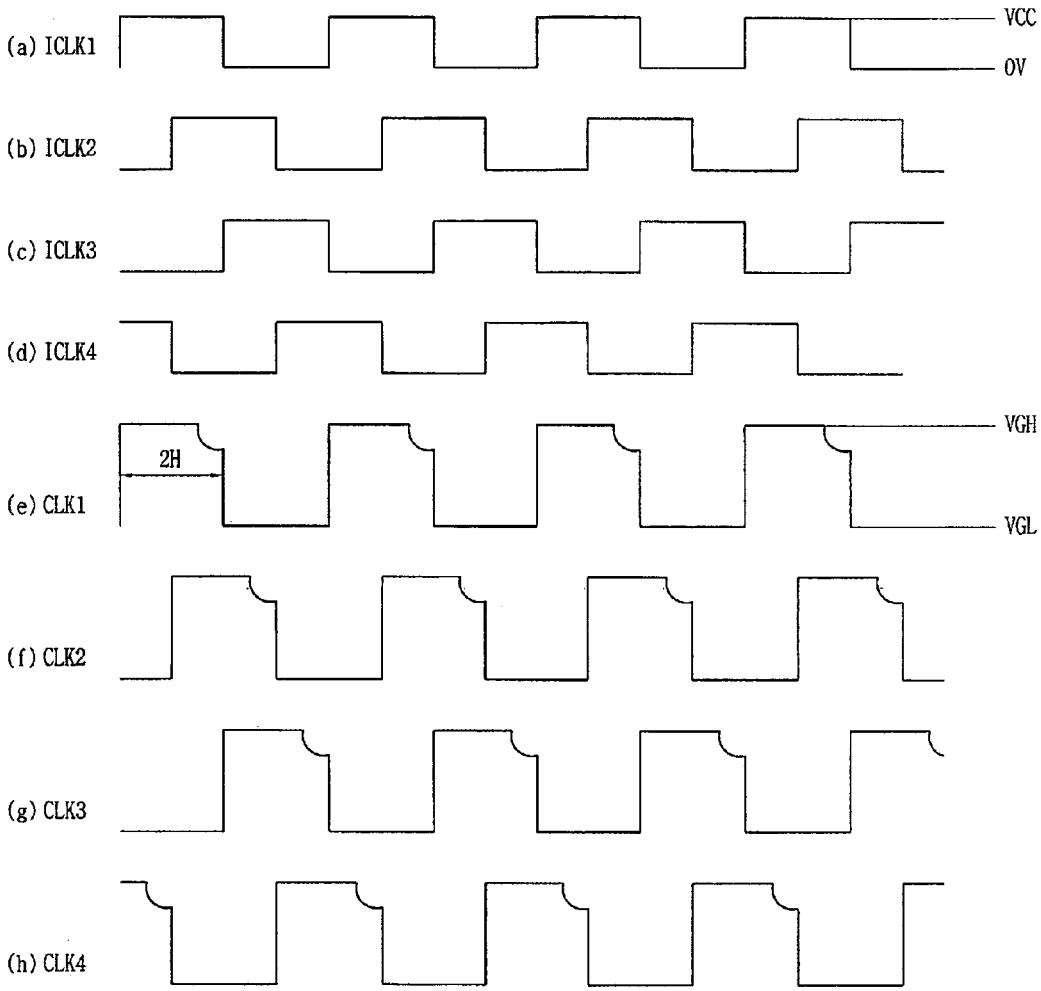
FIG. 6 shows exemplary clock signals level-shifted and modulated clock signals according to an embodiment of the invention.

FIG. 6 shows exemplary clock signals level-shifted and modulated clock signals according to an embodiment of the invention. Referring to FIGS. 4 and 6, the first level shifter 42A receives the VGHM1 signal from the first gate pulse modulator 41A and the first and third clock signals ICLK1 and ICLK3 from the timing controller (not shown). The first level shifter 42A also receives a voltage VGL to generate the clock signals of the level-shifted and modulated clock signals CLK1 and CLK3 of the odd-numbered lines as shown in FIGS. 6(*e*) and 6(*g*). Herein, the voltage VGL is a low logical voltage of a scan pulse set as an OFF voltage of the TFT.

Similarly, the second level shifter 42B receives the second gate ON voltage modulation signal VGHM2 from the second gate pulse modulator 41B, the second and fourth clock signals from the timing controller. The second level shifter also receives the voltage VGL to generate the level-shifted and modulated clock signals CLK2 and CLK4 of the even-numbered lines as shown in FIGS. 6(*f*) and 6(*f*).

The GIP 43, for example, the gate driver mounted in the liquid crystal panel, receives the clock signals CLK1, CLK2, CLK3 and CLK4 of the odd-numbered and even-numbered lines outputted from the first and second level shifters 42A and 42B, and also receives voltages VGH an VGL. The GIP 43 generates gate output signals GATE OUTPUT N−1, GATE OUTPUT N and GATE OUTPUT N+1 which have been modulated as shown in FIGS. 5(*e*), 5(*f*) and 5(*g*). Then, the GIP 43 outputs the generated gate output signals GATE OUTPUT N−1, GATE OUTPUT N and GATE OUTPUT N+1 to the gate lines of the liquid crystal panel. The generated gate output signals GATE OUTPUT N−1, GATE OUTPUT N and GATE OUTPUT N+1 are shifted with respect to one another to be overlapped, for example, by 1 H.

When the overlapping driving method is used as the gate driving method, because the gate output signal has the period of 2 H, it is not possible to output the gate modulation signal with respect to the 2-nth (even-numbered) line and (2n+1)-th (odd-numbered) line by using the single clock signal FLK. Thus, in an embodiment of the invention, the first and second gate ON voltage modulation signals VGHM1 and VGHM2 are generated using two different first and second clock signals FLK1 and FLK2, and the first gate ON voltage modulation signal VGHM1 is applied to the odd-numbered gate lines and the second gate ON voltage modulation signal VGHM2 is applied to the even-numbered gate lines, thereby outputting desired gate modulation signals also in the overlapping driving operation.

In accordance with an embodiment of the invention, two gate ON voltage modulation signals are generated by using two clock signals each having a different phase and one of them is applied to odd-numbered lines and the other is applied to even-numbered lines. Accordingly, a desired gate modulation signal can be outputted even in the overlapping driving operation. Thus, the gate modulation signals that can be used to perform modulation can be outputted even in the overlapping driving operation by using the first and second clock signals FLK1 and FLK2 each having a different phase. And thus, the appearance of flickers can be reduced.

It will be apparent to those skilled in the art that various modifications and variations can be made in embodiments of the present invention. Thus, it is intended that embodiments of the present invention cover the modifications and variations of the embodiments described herein provided they come within the scope of the appended claims and their equivalents.

What is claimed is:

1. A circuit for generating a gate pulse modulation signal, comprising:

a gate pulse modulation unit for generating two gate ON voltage modulation signals by using two clock signals each having a different phase;

a level shift unit for generating level-shifted and modulated clock signals of odd-numbered and even-numbered lines by using the gate ON voltage modulation signal; and a GIP for receiving the clock signals of the odd-numbered and even-numbered lines and outputting the clock signals to each corresponding gate line.

2. The circuit of claim 1, wherein the gate pulse modulation unit includes first and second gate pulse modulators for receiving the first and second clock signals each having a different phase and generating first and second gate ON voltage modulation signals, respectively.

3. The circuit of claim 1, wherein the level shift unit includes first and second level shifters for receiving the first and second gate ON voltage modulation signals from the gate pulse modulation unit and first to fourth clock signals from a timing controller, and generating clock signals of odd-numbered and even-numbered lines in a modulated form after being level shifted.

4. The circuit of claim 3, wherein the first to fourth clock signals are shifted to a gate low voltage level to a gate high voltage.

5. The circuit of claim 3, wherein the clock signals of the odd-numbered and even-numbered lines have a period of 2 H.

* * * * *